US006604471B1

(12) United States Patent
Tarver, Jr.

(10) Patent No.: US 6,604,471 B1
(45) Date of Patent: Aug. 12, 2003

(54) SOFA-BED-COUNTER UNIT

(76) Inventor: Samuel A. Tarver, Jr., P.O. Box 431, Folsom, LA (US) 70437

( * ) Notice: Subject to any disclaimer, the term of this patent is extended or adjusted under 35 U.S.C. 154(b) by 0 days.

(21) Appl. No.: 09/498,877

(22) Filed: Feb. 7, 2000

Related U.S. Application Data

(63) Continuation-in-part of application No. 09/070,099, filed on Apr. 27, 1998, now Pat. No. 6,109,189, which is a continuation-in-part of application No. 08/769,139, filed on Dec. 18, 1996, now Pat. No. 5,742,956.

(51) Int. Cl.[7] ..... A47B 3/00
(52) U.S. Cl. ..... 108/40; 108/35; 108/48
(58) Field of Search ..... 108/35, 40, 48

(56) References Cited

U.S. PATENT DOCUMENTS

| | | | | | |
|---|---|---|---|---|---|
| 1,699,496 | A | * | 1/1929 | Wasmuth | 108/40 |
| 2,647,562 | A | * | 8/1953 | Hoffar | 108/35 |
| 3,972,560 | A | * | 8/1976 | White | 108/40 |
| 5,408,936 | A | * | 4/1995 | Tseng | 108/40 |
| 5,513,574 | A | * | 5/1996 | Collins | 108/48 |

* cited by examiner

*Primary Examiner*—Lynne H. Browne
*Assistant Examiner*—James M. Hewitt
(74) *Attorney, Agent, or Firm*—Joseph T Regard Ltd

(57) ABSTRACT

A transportable living quarters configured for maximum comfort and spaciousness, with a relatively small footprint. A unique sofa/bed arrangement is contemplated, wherein first and second, facing fold-out sofas are provided which are convertible to a single bed, which may be full size or larger. One of the sofas further provides a mechanism to manipulate, via bracketed supports, the sofa back to form a long counter area, which, in the preferred embodiment of the invention, is situated adjacent to the kitchen counter and thereby extends same. The present invention further contemplates a dining/work table which is configured to be stored along the ceiling of the unit, in a relatively hidden capacity, and easily deployed between the first and second sofas when needed, providing a relatively large, stable work surface. The bathroom unit of the present invention contemplates a unique drain connection system, wherein the lavatory drain includes a drainpipe connection to a stationary drainpipe built into the wall structure of the unit, the connection accomplished without the requirement of hoses, pipe fittings or the like. The present invention may be utilized as a stand alone facility, or may be incorporated into a building or other structure in a temporary or permanent capacity, or in a camper, boat, or modular housing or the like, or any other location where a small, yet fully equipped living quarters is required.

1 Claim, 17 Drawing Sheets

FIG. 2b
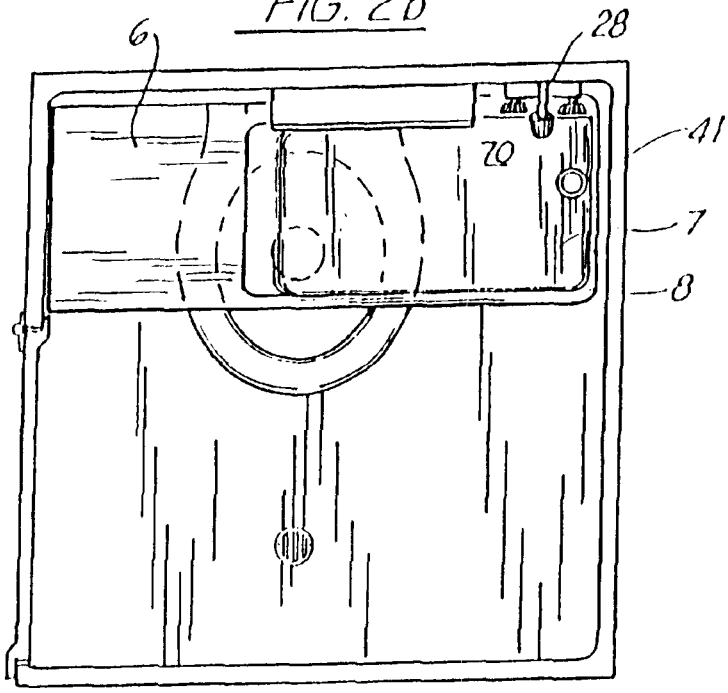
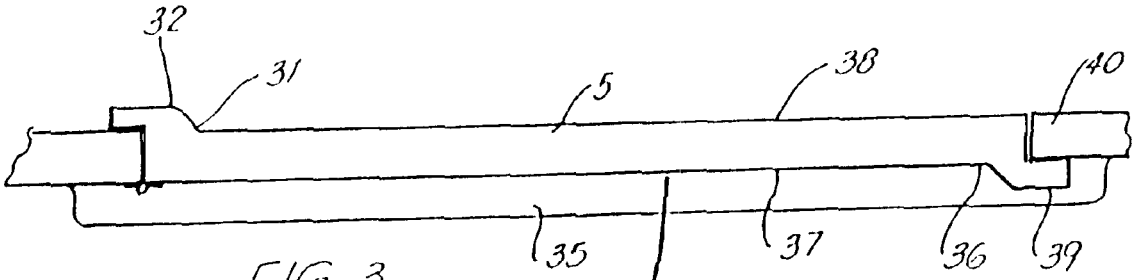
FIG. 3
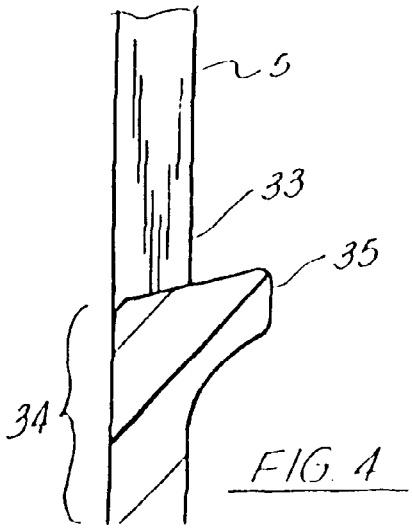
FIG. 4
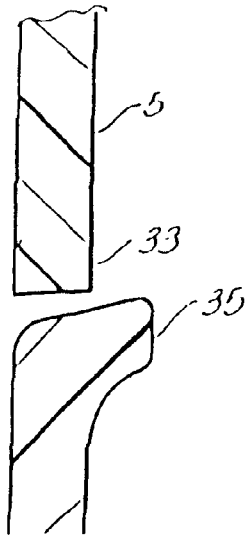
FIG. 5

FIG. 14
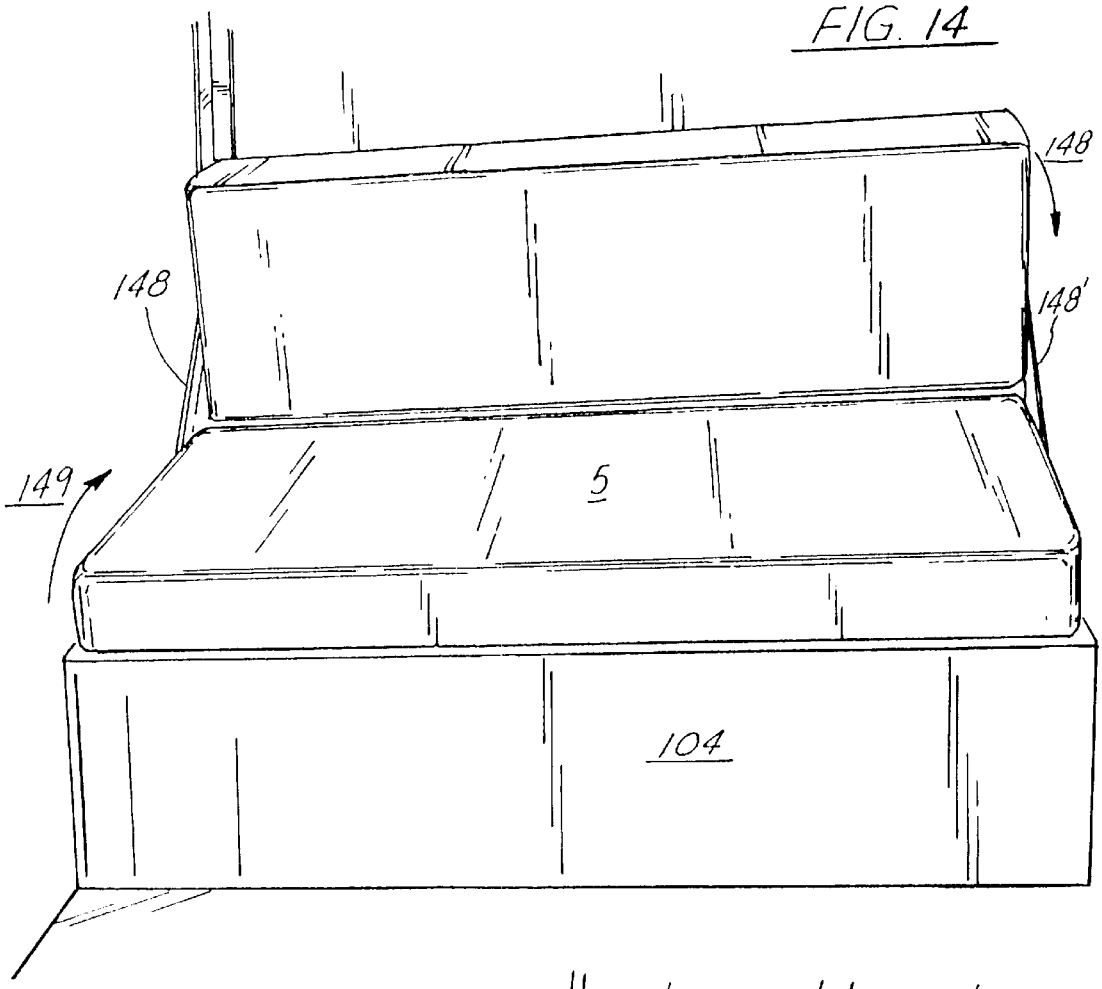
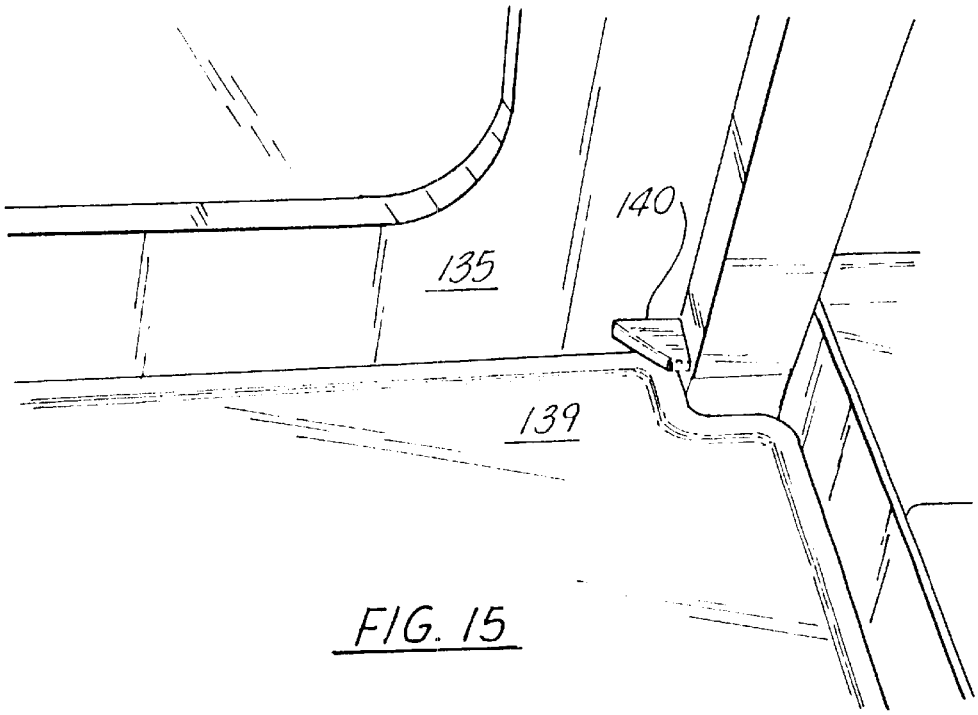
FIG. 15

SOFA-BED-COUNTER UNIT

STATEMENT OF CONTINUING APPLICATIONS

The present application is a continuation-in-part of U.S. Pat. No. 6,109,189, filed Apr. 27, 1998, entitled "Modular Living Quarters", which is a continuation-in-part of U.S. patent application Ser. No. 08/769,139, filed Dec. 18, 1996 issued Apr. 28, 1998 as U.S. Pat. No. 5,742,956, entitled "Modular Bathroom Unit".

TECHNICAL FIELD OF THE INVENTION

The present invention relates to portable, space saving living units, and in particular to transportable living quarters configured for maximum comfort and spaciousness, with a relatively small footprint. The preferred embodiment of the present invention includes a bathroom unit, kitchen area, and living/sleeping/work/dining area.

In order to enhance the efficiency of the layout of the present invention, a unique sofa/bed arrangement is contemplated, wherein first and second, facing fold-out sofas are provided which are convertible to a single bed, which may be full size or larger. One of the sofas further provides a means to manipulate, via bracketed supports, the sofa back to form a long counter area, which, in the preferred embodiment of the invention, is situated adjacent to the kitchen counter and thereby extends same.

The present invention further contemplates a dining/work table which is configured to be stored along the ceiling of the unit, in a relatively hidden capacity, and easily deployed between the first and second sofas when needed, providing a relatively large, stable work surface.

The bathroom unit of the present invention contemplates a unique drain connection system, wherein the lavatory drain includes a drainpipe connection to a stationary drainpipe built into the wall structure of the unit, the connection accomplished without the requirement of hoses, pipe fittings or the like. Also provided is a shower and toilet facility which may be utilized with no impositions or restrictions on the user, while the interior is configured to be watertight, with a sealed door, and an easily cleaned interior surface.

The present invention may be utilized as a stand alone facility, or may be incorporated into a building or other structure in a temporary or permanent capacity, or in a camper, boat, or modular housing or the like, or any other location where a small, yet fully equipped living quarters is required.

BACKGROUND OF THE INVENTION

While the prior art has contemplated numerous and diverse space-saving living quarters, kitchens, bathrooms, and the like, none are believed to teach, contemplate, or otherwise suggest the present invention.

Patents which might be considered at least pertinent with regard to the present invention include:

| Patent Number | Inventor | Date of Issue |
|---|---|---|
| 5261127 | Tsipov | 11/16/93 |
| 5111626 | Fortune | 05/12/92 |
| 4653128 | Canalizo | 03/31/87 |
| 4133057 | Rivetti | 01/09/79 |
| 4110855 | Acker | 09/05/78 |
| 3986218 | Mizelle | 10/19/76 |

-continued

| Patent Number | Inventor | Date of Issue |
|---|---|---|
| 3800337 | Mizelle | 04/02/74 |
| 3533200 | Zoebelein | 10/13/70 |
| 1360478 | Wajtukiewicz | 11/30/20 |
| D251,604 | Clow | 04/17/79 |

U.S. Pat. No. 4,133,057, issued 1979 teaches a "Toilet Set to be Installed in a Medium Sized Room", wherein there is provided a combination commode, tilting sink/shower unit, all provided in a nominal area, which functions as a shower stall.

U.S. Pat. No. 4,653,128 issued 1987 contemplates a "Modular Bathroom Unit" teaching a shared plumbing and cabinets.

U.S. Pat. No. Des 251,604 teaches a "Combined Shower Stall and Floor Toilet".

U.S. Pat. No. 5,261,127, issued in 1993, teaches a shower stall having a pivoting sink, which is configured to store in a vertical configuration, providing space for utilization of the stall.

U.S. Pat. No. Des 203,253 teaches a "Prefabricated Bath Facility", wherein there is provided a sink, commode, and shower stall in a single, unitary structure.

U.S. Pat. No. 3,533,200 contemplates a "Prefabricated Room Assembly", which may be in the form of a stack able, modular bathroom.

U.S. Pat. No. 5,111,626, issued 1992, teaches a "Self-Contained Modular Unit", which contains a shower, toilet, lavatory, and sleeping facilities.

With regard to the sofa/bed arrangement, U.S. Pat. No. 3,986,218 teaches a "Reversible Settee-Bed for a Dinette of a Recreational Vehicle", wherein the back rotates forward to form a bed; however, no provision is made for a counter top support formed from the back in the present invention, and such is not believed to be immediately possible from the design as taught in this patent.

U.S. Pat. Nos. 1,360,478, 3,800,337, and 4,110,855 teach other sofa-sleepers wherein the backrest is pulled forward and flipped over, via bracketed support, to form a bed.

Thus, while the known prior art has contemplated several, diverse modular housing configurations and embodiments, none appear to have contemplated the unique combination of flexible application with space-saving characteristics, as has been taught and claimed in the present invention.

GENERAL SUMMARY DISCUSSION OF THE INVENTION

Unlike the prior art, the preferred embodiment of the present invention provides a comfortable, versatile, sanitary, easy to implement and use, and cost effective modular bathroom unit.

The preferred embodiment of the present invention comprises a modular bathroom system configured to provide all of the features of a full-sized bathroom, but in the space of a small closet. The present system may be a one-piece, fiberglass molded unit or the like, and may be installed in a vehicle, such as a commercial freight truck or camper, or may be provided as a modular, portable, stand-alone bathroom for outdoor or indoor use, or may be simply a prefabricated bathroom module for placement in condominiums, warehouses, or any other diverse location where a small, yet full-featured bathroom is desired.

The preferred embodiment of the present invention comprises a shower stall unit having therein a commode, sink, and mirror, all arranged so as to provide convenient, unhindered use of each of the features, as desired. The lavatory unit is hinged along one end to the wall, so as to allow lifting of same for storage against the wall, to provide for use of the commode or shower.

A built-in roll paper holder is provided in the lavatory unit for facilitating ease of dispensing, while providing a dry, compartmented storage area, enclosing the paper sufficiently for preventing contact with water during showering, utilization of the lavatory, or like activity.

The preferred embodiment of the present invention further teaches a unique drain connection system, wherein the lavatory drain includes a connect able drainpipe connection to a stationary drainpipe built into the wall structure of the unit, the connection dis-disconnecting upon the lifting of the sink for storage against the wall for showering, utilizing the commode, or other activity, and automatically re-connecting in a watertight, reliable seal upon the placement of the lavatory in the horizontal use position, the connection accomplished without the requirement of hoses, pipe fittings or the like.

The invention further contemplates a modular living compartment, which may include the modular bathroom of the present invention, the exemplary embodiment of the living compartment configured to provide about an 8'×8' footprint, making it especially useful for utilization as a living quarters mounted to the cab of a tractor-trailer system.

The modular living compartment includes a bathroom as contemplated above, a kitchen unit with refrigerator and stove or microwave, a dining/living area convertible to a sleeping compartment, and other conveniences commonly available in one's home.

The modular living compartment further includes a unique rollbar/conduit system for providing protected water and electrical about the compartment, wherein the rollbar encases major electrical and water conduits.

The living compartment may include an electrical generator, heater, water supply, air conditioning, television, ventilation, and storage.

The living compartment may also include a first entryway, which, when affixed to a tractor trailer, could provide direct access into the cab of the vehicle, as well as a second entryway, which may be in the form of an emergency exit.

In order to enhance the efficiency of the layout of the present invention, a unique sofa/bed arrangement is contemplated, wherein first and second, facing fold-out sofas are provided which are convertible to a single bed, which may be full size or larger. The first sofa is situated adjacent to the modular bathroom unit, and includes a bottom cushion which may be raised to access a storage area, with the back spaced from the wall of the structure to provide a storage area for clothing.

The rear back rest of the sofa is affixed end brackets to allow for the pulling forward and rotation of the back rest to provide a horizontal support, to form part of a bed in front of and in line with the sofa seat pad. The second sofa further provides a means to manipulate, via bracketed supports, the sofa back to form a long counter area, which, in the preferred embodiment of the invention, is situated adjacent to the kitchen counter and thereby extends same.

The present invention further contemplates a dining/work table which is configured to be stored along the ceiling of the unit, in a relatively hidden capacity, and easily deployed between the first and second sofas when needed, providing a relatively large, stable work surface.

It is therefore an object of the present invention to provide a modular bathroom system which is relatively comfortable, durable, sanitary, and easily maintained and implemented.

It is another object of the present invention to provide a modular bathroom system which provides a commode, lavatory, and shower in a relatively small footprint, yet providing a spacious accommodation to the user.

It is another object of the present invention to provide a tilting lavatory wherein there is provided a drain conduit quick dis-connect/re-connect, providing an automatic, secure, odor-free drain connection, which is automatically implemented upon lowering of the lavatory to the horizontal use position, and disengaged upon lifting of the lavatory to the storage/non-use position.

It is another object of the present invention to provide a modular living system which may be secured to a tractor trailer, providing living, sleeping, and bathroom facilities.

It is still another object of the present invention to provide a modular bathroom facility which includes a lavatory facility which provides a full-sized bathroom sink when needed, yet is storable in an upright position, providing access to shower and toilet facilities.

It is another object of the present invention to provide a unique rollbar/conduit system for providing protected water and electrical about a modular living compartment, wherein the rollbar encases major electrical and water conduits.

It is another object of the present invention to provide a hinged lavatory unit including a built-in roll paper holder for facilitating ease of dispensing, while providing a dry, compartmented storage area, enclosing the paper sufficiently for preventing contact with water.

It is another object of the present invention to provide a sofa or sofa-bed system which comprises first and second sofas facing one another in spaced relationship, the sofas configured to provide for the back rests of each sofa to pull forward and rotate to provide a continuous, horizontal bed surface.

It is still another object of the present invention to provide a dining/work table which is configured to be stored along the ceiling of the unit, in a relatively hidden capacity, and easily deployed between the first and second sofas when needed, providing a relatively large, stable work surface.

Lastly, it is an object of the present invention to provide a modular living system which can accommodate three or more people, providing sleeping, living, kitchen and toilet facilities, in a footprint area of, for example, 8'×8'.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 2*b* is a top, cut-away view of the invention of FIG. 1, illustrating the placement of the lavatory unit in its use position relative to the commode and shower drain.

FIG. 3 is a top view of the door of the invention of FIG. 1, illustrating the side edge door seals for preventing the leakage of water therethrough.

FIG. 4 is a side, cross-sectional view of the door of the invention of FIG. 3, illustrating the bottom door seal for preventing the leakage of water therethrough.

FIG. 5 is a side, cross-sectional view of the door of the invention of FIG. 4, illustrating the door in a slightly open position, and the relationship of the door seal thereto.

FIG. 14 is a frontal view of the second sofa of the present invention, illustrating the pivotal connection of the seat cushion so as to allow for the lifting thereof to access a storage area thereunder.

FIG. 15 is an upper, isometric view of the counter of the sofa of FIG. 10, illustrating the interface of a rear corner of the counter with a corner stop.

DETAILED DISCUSSION OF THE INVENTION

Figure 1:
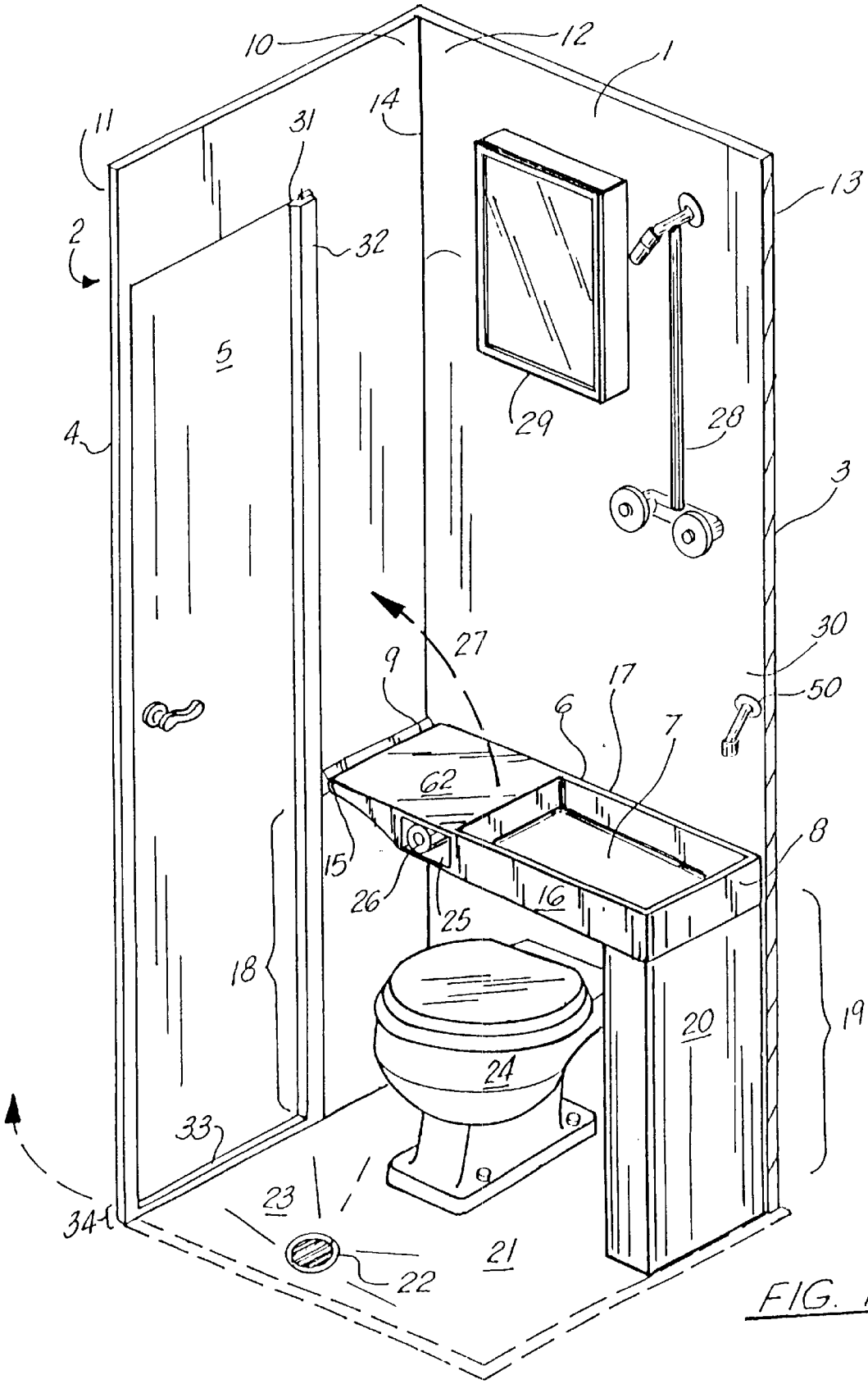
FIG. 1 is an isometric, partially cut-away view of the preferred embodiment of the modular bathroom system of the present invention, illustrating various components of the invention.

Referring to FIG. 1 of the drawings, the bathroom unit 1 of the modular bathroom system 2 of the present invention includes first 3 and second 4 walls, each said wall having first 10, 12 and second 11, 13 edges, respectively, said first and second walls joined at said first edges to form a corner 14.

In the present exemplary embodiment of the invention, a door 5 is formed in the second wall 4, although said door could be as easily formed in other walls with like results. As shown, the door includes a door knob, or other latch means for retaining the door in a closed position.

Continuing with FIG. 1, a lavatory unit 6 is shown, having a sink 7 disposed therein, the lavatory unit having first 8 and second 9 ends, the first end 8 pivotally joined to the second wall 4 via hinge member 15, while the first end 8 rests upon drain box 20.

The lavatory unit 6 has front 16 and rear 17 edges, the rear 17 edge juxtaposed first wall 3, the front 16 edge in an open area, the front edge further having formed therein, between the sink 7 and second end 9, a paper compartment 25, configured to hold and dispense a roll of toilet paper 26 therein. A flat table surface 62 may be provided adjacent to the sink 7, for placement of toiletries, etc. during use.

The hinge 15 supporting the second end 9 of lavatory unit 6 is spaced 18 above the floor 21 so as to provide comfortable use to a standing user, and is spaced to retain the second end 9 of the lavatory unit 6 at a height about equal to the top of the drain box 20.

As shown, the hinge connection of lavatory unit allows the lavatory to be lifted 27 by the second end 9, pivoting the unit from a horizontal, use position, to a vertical, storage position. More features of the lavatory unit will be discussed infra.

Continuing with FIG. 1, the floor 21 has formed to slope 23 to a drain 22, positioned for draining shower water, as well as cleaning the unit.

Situated generally adjacent to the first wall 3 is a commode 24, which can comprise a recreational vehicle-type toilet, or a standard toilet, configured to provide a relatively low profile, under the lavatory unit 6, and is positioned to provide unencumbered use with the lavatory in the vertical storage position.

Also shown is a shower unit 28, which may be positioned on the first 3 wall, or another wall with equally satisfactory results, and a lavatory water faucet 50, which may have hot and cold water controls, and should be positioned upon the wall, outside of the swing arc of the lavatory unit so as not to incumber pivotal movement thereof. In the alternative, the faucet 50 may be built into the lavatory unit, and connected to the water supply by flexible hose or the like, or the shower unit 28 may be on a hose, to allow use as a faucet for the sink and sprayer for washing dishes and the like. Further, the water faucet 50 may be able to pivot to swing out of the way, and may be controlled by the shower water control knobs, with a selector switch for shower or faucet.

Also situated above the lavatory unit in the present, exemplary embodiment of the invention, is a mirror 29, which may also contain a medicine cabinet.

Situated along the inside edge 31 of the door 5 is a splash guard 32, configured to keep water spray within the room, especially when the shower is in operation. The bottom edge 33 of the door is situated above the floor 21, via spacer 34, to prevent water leakage therethrough.

Further, as shown in FIG. 4, the bottom 33 of door 5 interfaces a lip 35 to further seal the door to prevent liquid therethrough, allowing for unhindered opening, as shown in FIG. 5, when desired.

Referring to FIG. 3, the door 5 includes an outside edge 36, and inside edge 31, an outside 37, and an inside 38. Provided along the outside edge of the door, emanating from the outside 38 is a second splash guard 39, preventing the migration of water between the door 5 and wall 40, and working in conjunction with splash guard 32, situated along the opposing edge, along the inside of the door, to prevent the passage of water therethrough.

Referring now to FIG. 2B, formed generally adjacent to the first end 8 of the lavatory unit 6 of the exemplary embodiment of the present invention a drain 41, with the sink 7 sloping 70 towards said drain 41. As shown, the shower 28 could, as an alternative embodiment of the present invention, function as a sink for the faucet, either as a fixed unit, or via hose connection.

Figure 2A:
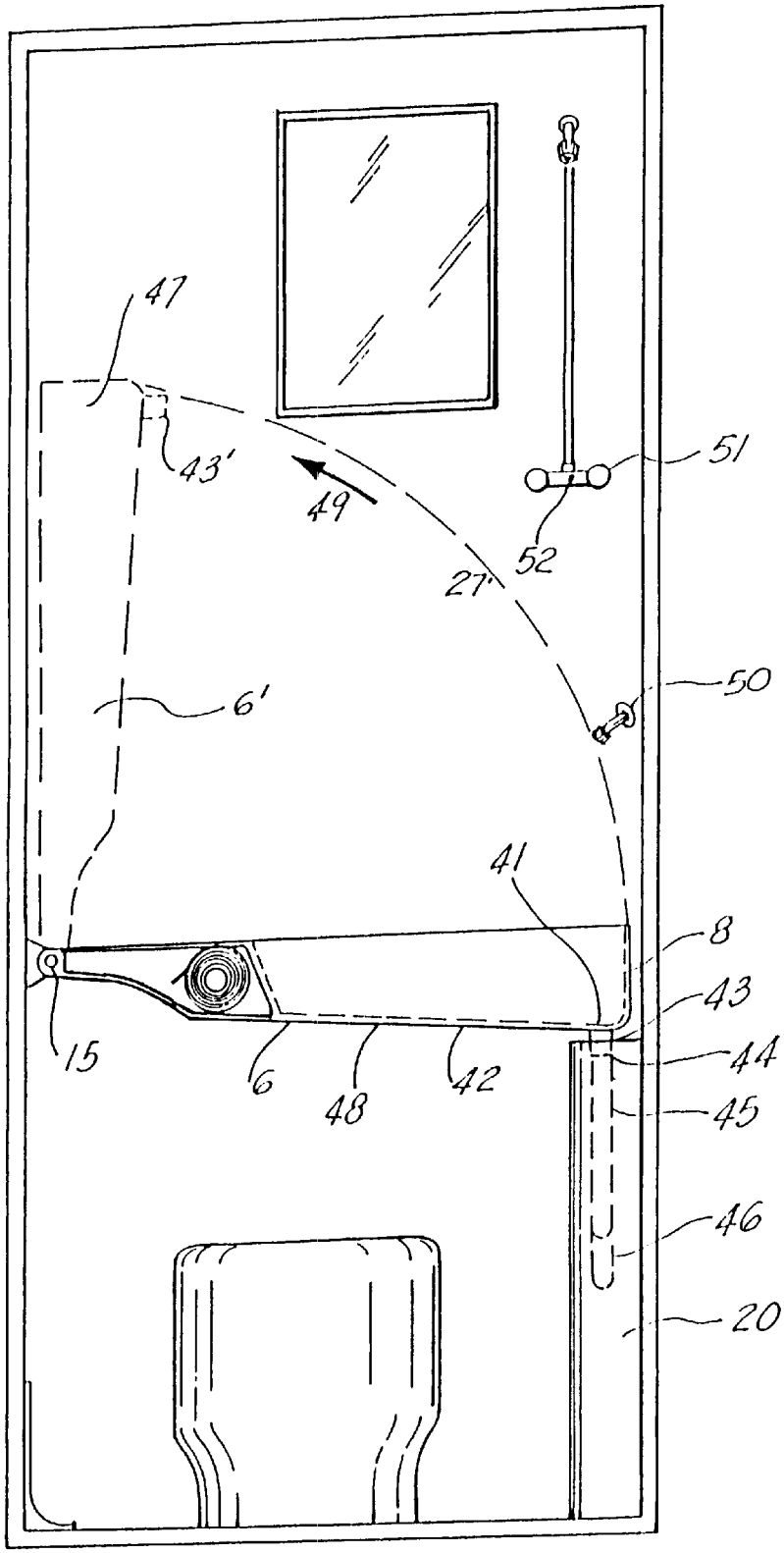
FIG. 2*a* is a frontal, cut-away view of the invention of FIG. 1, illustrating the movement of the lavatory unit from the horizontal, use position to the vertical, storage position, with the drain conduit shown in phantom.

As shown in FIG. 2A, emanating with the underside 42 of the sink 6 from the drain 41 is a male drain piece configured to communicate with a female drain coupling 44 originating a drain conduit 45 formed in the drain box 20, the coupling of the male drain piece with the female drain coupling taking place when in the lavatory unit 6 is in the horizontal use position 48. The drain conduit 45 may include, as shown, a pea trap 46 for preventing the emission of fumes from the dirty water, which may be piped to sewerage, or may be tanked in a storage tank under the present unit.

As further illustrated in FIG. 2A, the lavatory 6, may be raised 49, as earlier discussed, so as to pivot the hinge 15, raising the first end of the lavatory unit 6' (in phantom) to a vertical storage position 47. To retain the lavatory unit in the vertical, storage position, the hinge may be configured to provide resistance, or there may be provided a latch, strap, or any number of other retaining means already known and used in the art.

The arc 27' or the pivot motion of the lavatory unit is illustrated in phantom, so as so indicate the appropriate positioning of, for example, the faucet 50, so as not to block the raising or of the lavatory unit. As earlier indicated, the faucet can be made to rotate so as to be adjustable outside of the arc of the pivot motion of the lavatory unit, as desired. As earlier indicated, the valves 52 controlling the shower head might also, if desired, be switchable via switch 52 to control the faucet, as desired, or the faucet might have its own controls.

In the preferred embodiment of the present invention, the modular bathroom system of the present invention is a fiberglass structure fashioned from a mold utilizing conventional fiberglass fabrication methods. An example of the present invention would have outside measurements as follows: ##, and would weigh, fully equipped, about ## lbs.

Preferably, the present system would also include a heater/vent unit in the ceiling, with exhaust to the outside, and may include a sun dome which could be opened, for providing light and ventilation in situations where electricity would be unavailable.

The commode unit could comprise a stand-alone, chemical toilet, which would not require a water source or separate septic tank, or it could comprise a conventional toilet unit, with a conventional floor toilet hookup and seal, with either septic hookups exterior the unit, or a septic tank built under the floor. Likewise, a grey water tank or outside drain hookups may be provided, as desired, for the drain water from the lavatory or floor/shower drain.

Similarly, an exterior water supply hookup may be provided, and/or a water tank may be build into the floor of the unit, as desired; such designs already exist in the art, and are commonly found in boats, recreational vehicles, campers, and the like.

Figure 6:
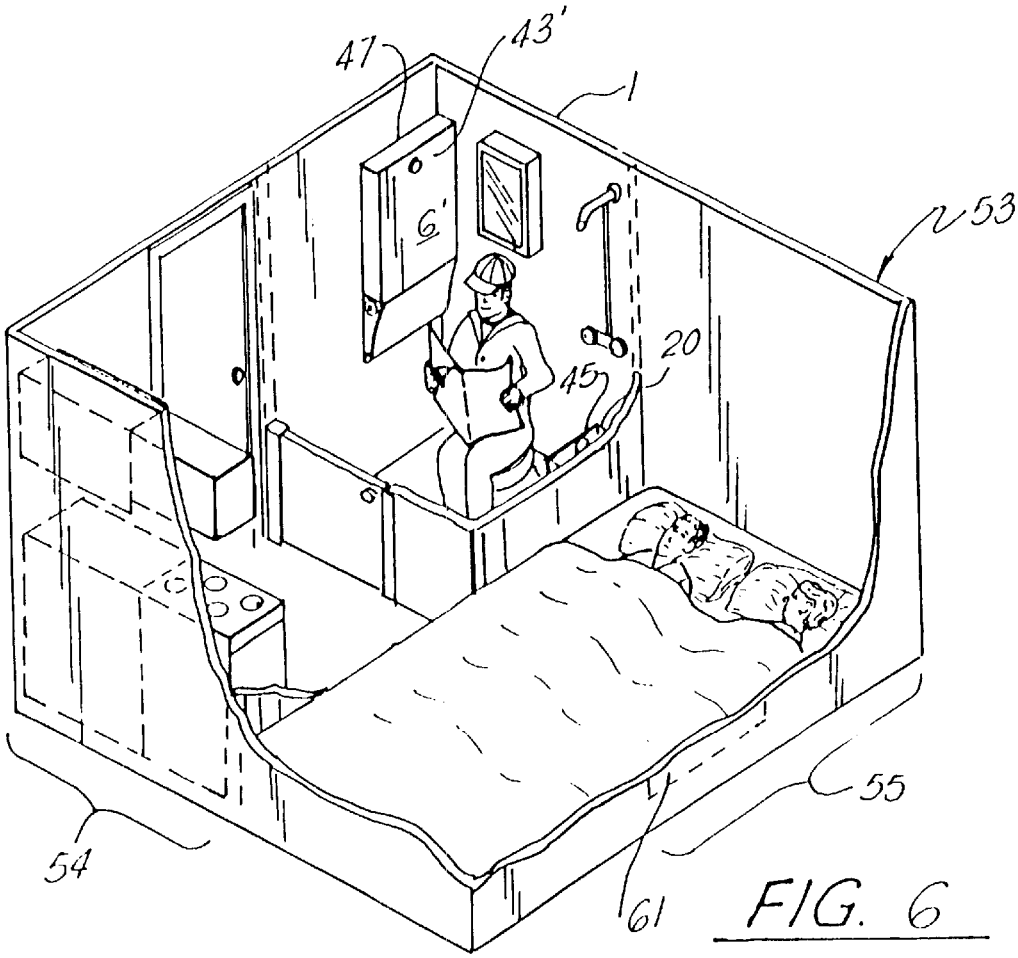
FIG. 6 is an isometric, partially cut-away view illustrating the layout of an exemplary living unit which includes the modular bathroom unit of the present invention, particularly configured for placement behind the cab of a tractor/trailer vehicle.
Figure 8:
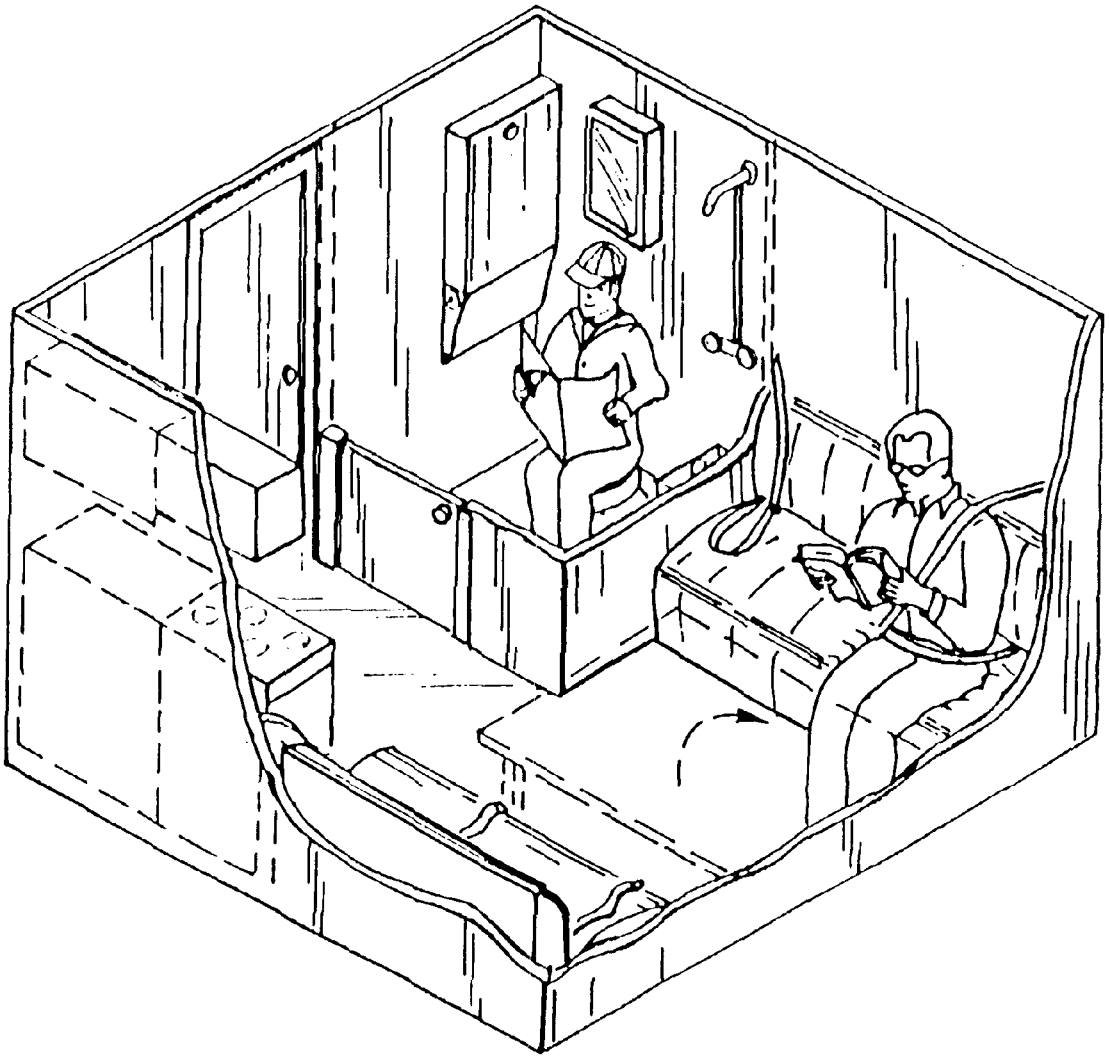
FIG. 8 is an isometric, partially cut-away view of the invention of FIG. 6, illustrating the living area converted from the bedding configuration to the dining configuration, with the table in phantom, and seat belts along the bench seats.

FIG. 6 illustrates an alternative embodiment of the present invention, comprising a living modular living unit 53 including the bathroom unit 1 of the present invention. As shown, the sink 6' is shown in its upright, vertical storage position 47, exposing the male drain piece 43', which is configured to interface with the drain conduit 45 of the drain box 20, as earlier discussed.

As further shown, the modular living area is configured to provide a small footprint, for example, 8'×8', such that it might be placed upon, for example, behind a tractor-trailer cab., the modular living unit further providing a kitchen area 54, and a bunk/dining/living area 55, the system configured to provide a comfortable, sanitary, relatively roomy, and versatile living system, when compared to other prior art systems.

An emergency escape panel or door 61 may be provided to allow for occupants an alternative exit in the event of fire, assault, or other emergency situation.

Figure 7:
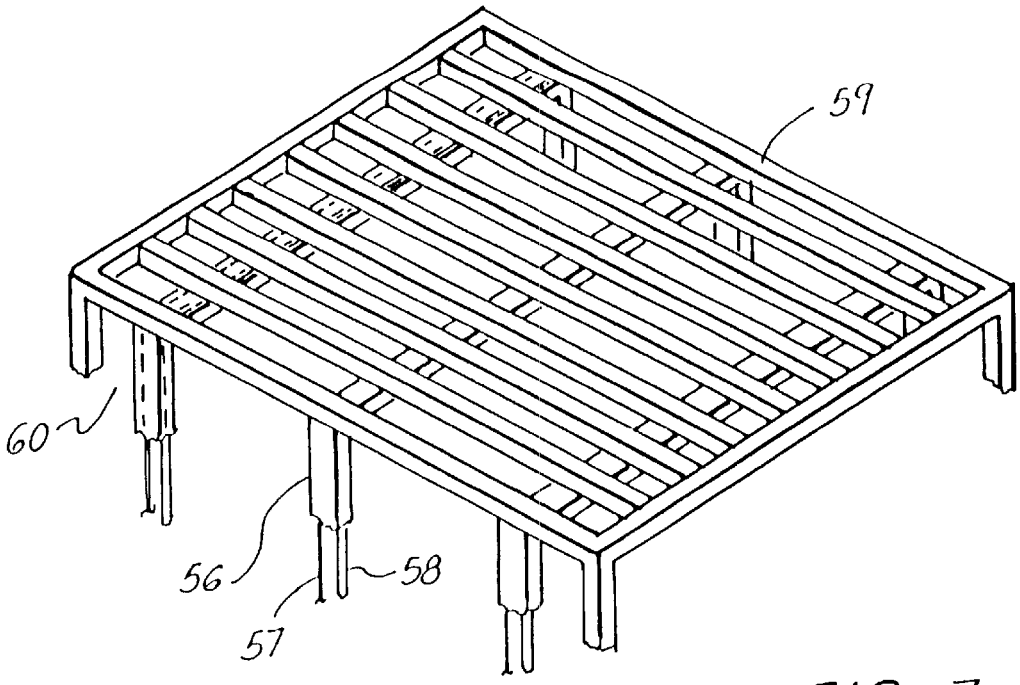
FIG. 7 is an isometric view of an exemplary rollbar configuration, which rollbar is configured to further provide a conduit for the passage of electrical and water pipes therethrough.

Referring to FIG. 7, the present invention may have built into its side walls 60 and ceiling 59 a rollbar 56 or steel conduit or the like, rectilinear or cylindrical, the rollbar configured to encase electrical 57 and water conduits 58, providing enhanced protection and structural integrity for the modular building unit, as well as increased protection for the electrical and water from outside interference. While FIG. 7 illustrates a steel cage construction, this is by no means required of the present embodiment, and the rollbar/conduit arrangement can be utilized with most any construction, including fiberglass, forming a single, unitary structure, or foam core, etc.

In the preferred embodiment of the invention of the modular living system, the floor, side walls 60 and ceiling 59 may be fabricated of, for example, material such as inner and outer sheets of aluminum having foam or other insulation juxtaposed therebetween. Alternatively, the sidewalls, ceiling, and floor may be fabricated of, for example, molded fiberglass or plywood; again, insulation would be desirable.

Figure 9:
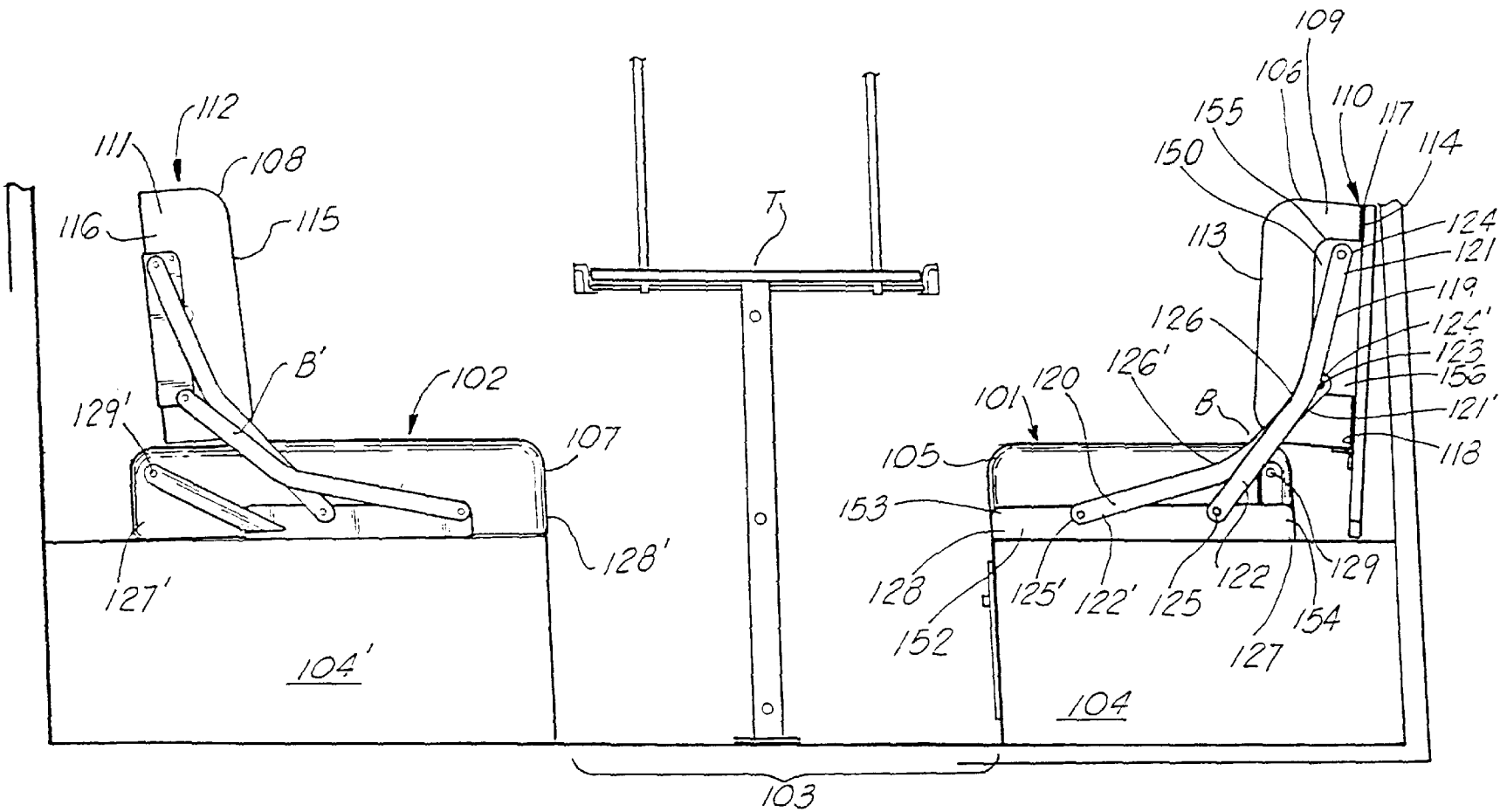
FIG. 9 is an end view of the dining/sleeping area of the preferred embodiment of the present invention, illustrating the placement and configuration of the preferred table and first and second sofas forming the bed, with the first sofa convertible to form a counter.

Referring to FIG. 9, the dining/sleeper/living area of the present invention comprises first 101 and second 102 sofas facing in spaced relationship 103, having a retractable table T therebetween when desired.

Each sofa 101, 102 is supported by a base unit 104, 104', respectively, which offers storage space therein, as will be more fully discussed infra. Each sofa 101, 102 includes a seat 105, 107 and back 106, 108 respectively, each back and seat having opposing first 109, 111 and second ends 110, 112, the backs 106, 108 having a front face 113, 115, a back face 114, 116, a top 117, and a bottom 118.

Situated at the opposing ends 109, 110 and 111, 112 of sofas 101, 102 respectively are support brackets B, B', each support bracket comprising first 119 and second 120 bracket members, each bracket member 119, 120 having first 121, 121', and second 122, 122' ends, which are pivotally connected 124, 124' and 125, 125' to connector members 150, 152 respectively. Situated between the first and second ends of said bracket members 119, 120 are medial areas 123, 123', each having a bend 126, 126, respectively, each bend in the general direction of the seat in the seating configuration, shown. As shown, connector members 150, 152 are affixed to the opposing ends of back 106 and seat 105, respectively.

Continuing with FIG. 9, back connection member 150 has upper 155 and lower 156 ends, while seat connection member 152 includes forward 153 and rear 154 ends; the first end 121' of second bracket member 120 is pivotally connected to connection member 150 at said lower end 156, while the second end 122' of second bracket member 120 is pivotally connected to connection member 152 at said forward end 153, while the first end 121 of first bracket member 119 is pivotally connected to connection member 150 as said upper end 155, while the second end 122 of the first bracket member 119 is pivotally connected to connection member 152 at said rear end 154.

Figure 20:
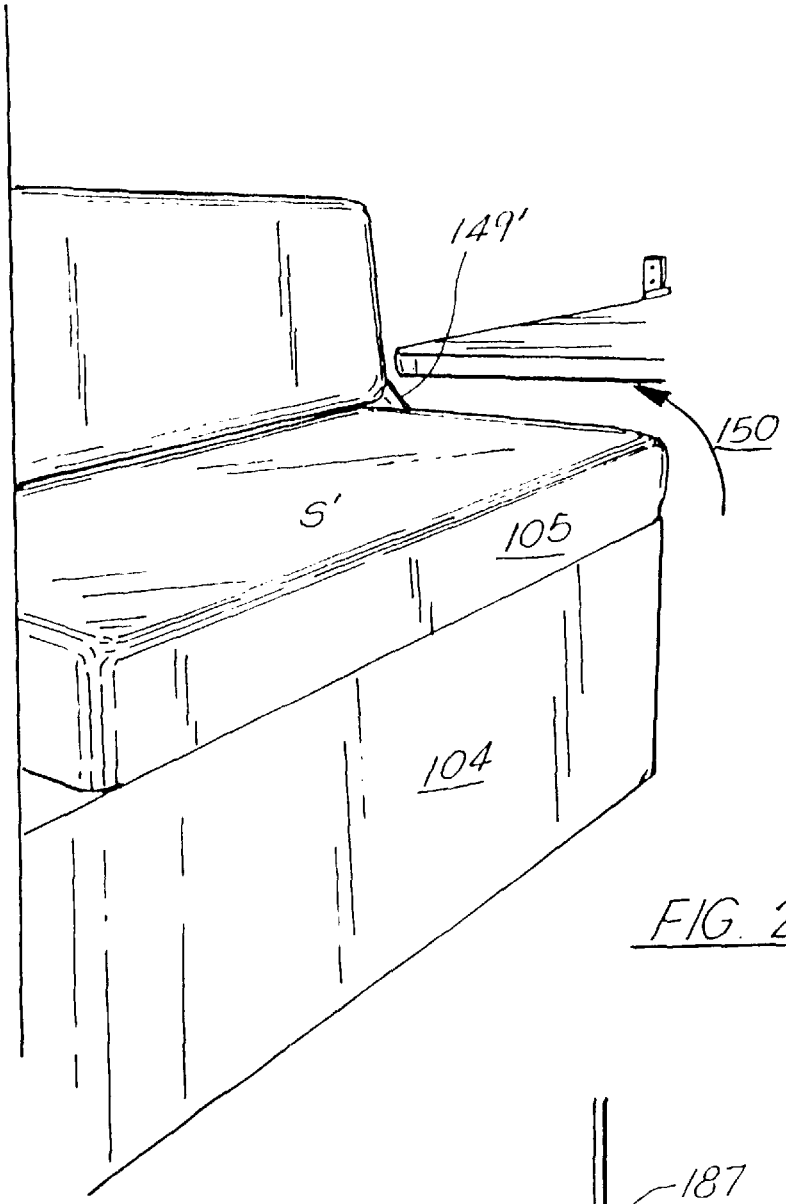
FIG. 20 is an isometric view of the first sofa of the present invention illustrating the pivotal lifting of the seat cushion to reveal a storage area underneath, as well as the placement of the kitchen area thereto.

The opposing ends of first 105 and second 107 sofa seats include front 128, 128' and rear 127, 127' portions, the rear portion of each end having emanating therefrom pivotal connectors 129, 129' configured to engage support brackets 148, 148', (149' in FIG. 20) or adjoining side walls, as shown in FIGS. 14 and 20, to allow a user to lift 149, 150 the sofa seat S, S',. As further shown, a drawer 151 or other door may be provided for storage, in addition to the lifting seat cushion, as desired.

Figure 10:
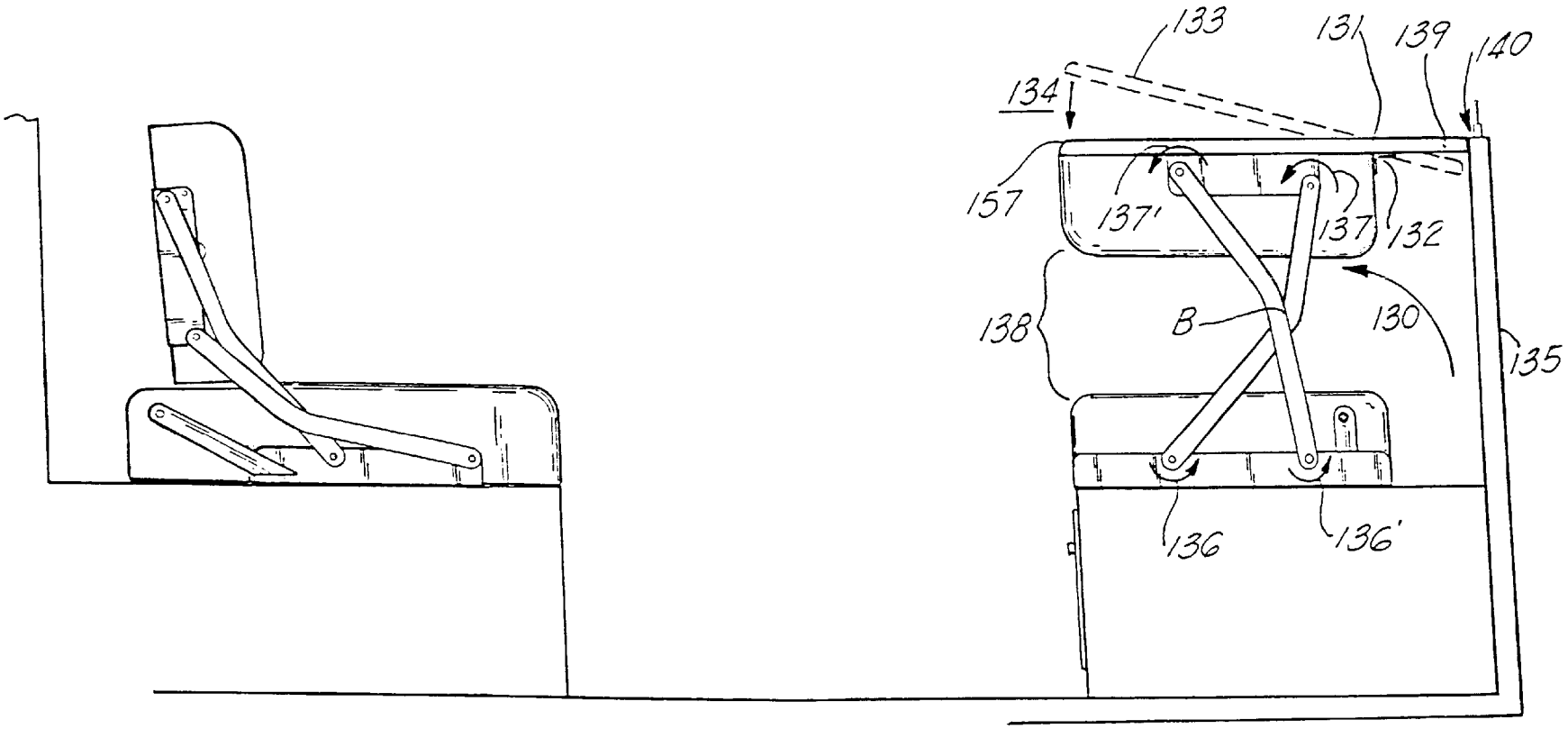
FIG. 10 is an end view of the invention of FIG. 9, illustrating the first sofa converted to form a counter/work area.

Continuing with FIGS. 9 and 10, the back 106 of first sofa 101 is configured to be pivoted 136, 136', 137, 137' forward 130 via brackets B into a generally horizontal position, such that a counter 131, pivotally 132 affixed to the rear 114, 118 of back 106 via piano hinge 132 or the like near the bottom 118, forming a raised 138, planar support surface.

As shown, the hinged connection of counter 131 to the back 106 allows for the counter 131 to be positioned 131 and manipulated 134 as necessary during positioning of the back 106 to allow for a relatively tight clearance between the seat back and the wall 135 when in the seating position.

Figure 11:
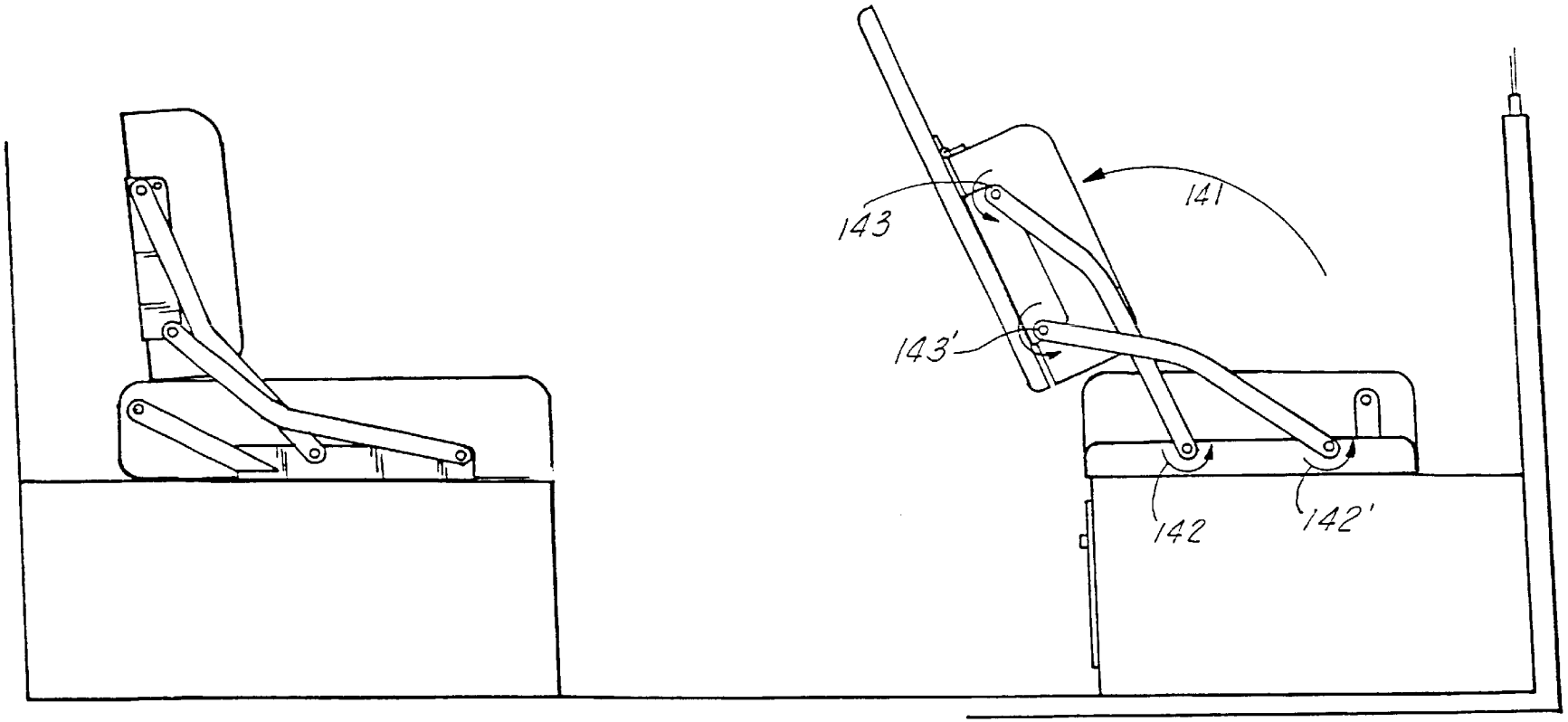
FIG. 11 is an end view of the invention of FIG. 10, illustrating the rear cushion of the first sofa being further rotated, via end brackets, in the process of forming a bed.
Figure 12:
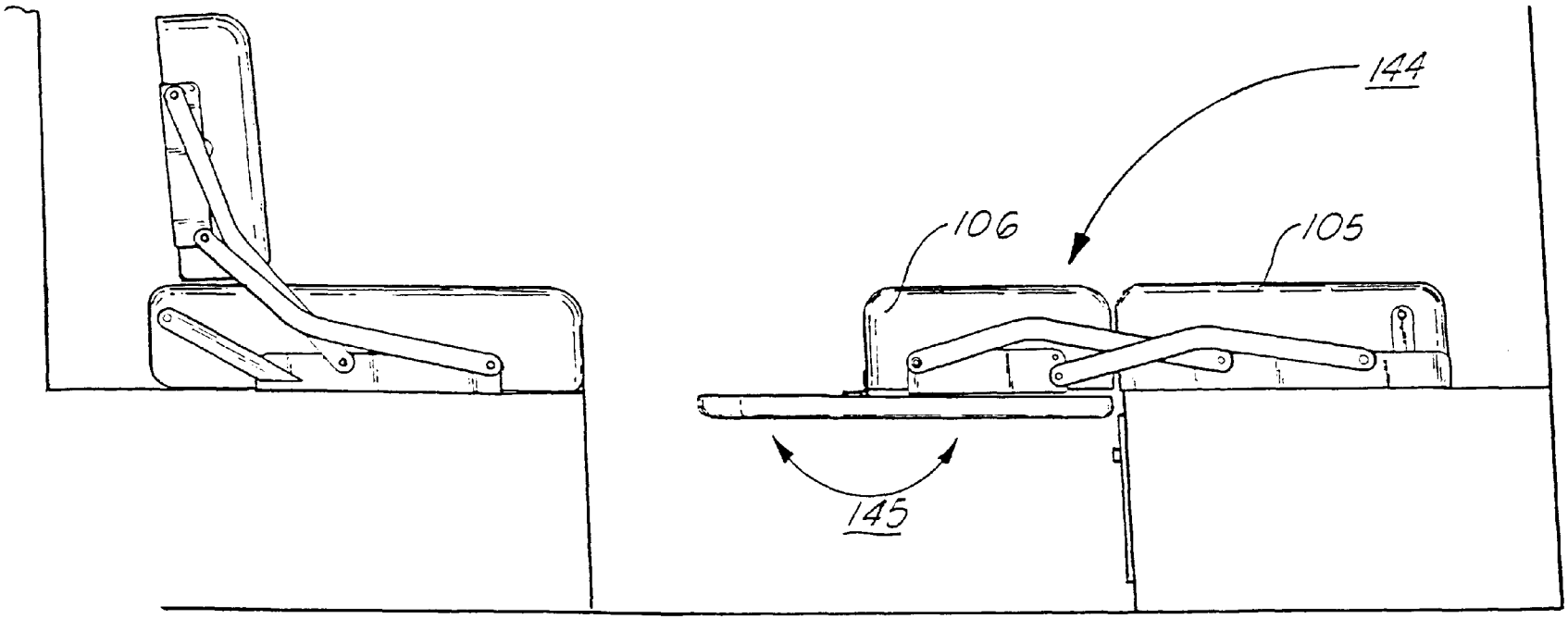
FIG. 12 is an end view of the invention of FIG. 11, illustrating the rear cushion of the first sofa positioned in generally horizontally aligned fashion with the seat cushion of the first sofa, forming same into a bed, with the counter surface situated thereunder.

Referring to FIGS. 10 and 15, a rear corner 139 of the counter 131 may be configured to engage a stop 140 affixed to the wall 135 or adjacent fixture, to stabilize the counter 131 in its horizontal position; a lifting of the frontal portion 157 of the counter would disengage the counter with the stop, allowing for pulling forward 141 of the back, as shown in FIG. 11, while rotating the back counter clockwise via pivoting 143, 143', 142, 142' of bracket, so that, with further pulling forward 144, the back is positioned for use as a bed, as shown in FIG. 12, with the back 106 now in generally horizontal position; the counter, now under the back, may be manipulated 145 via the hinged connection to place same in horizontal to allow for the back rest of the second sofa to be placed next.

Figure 13:
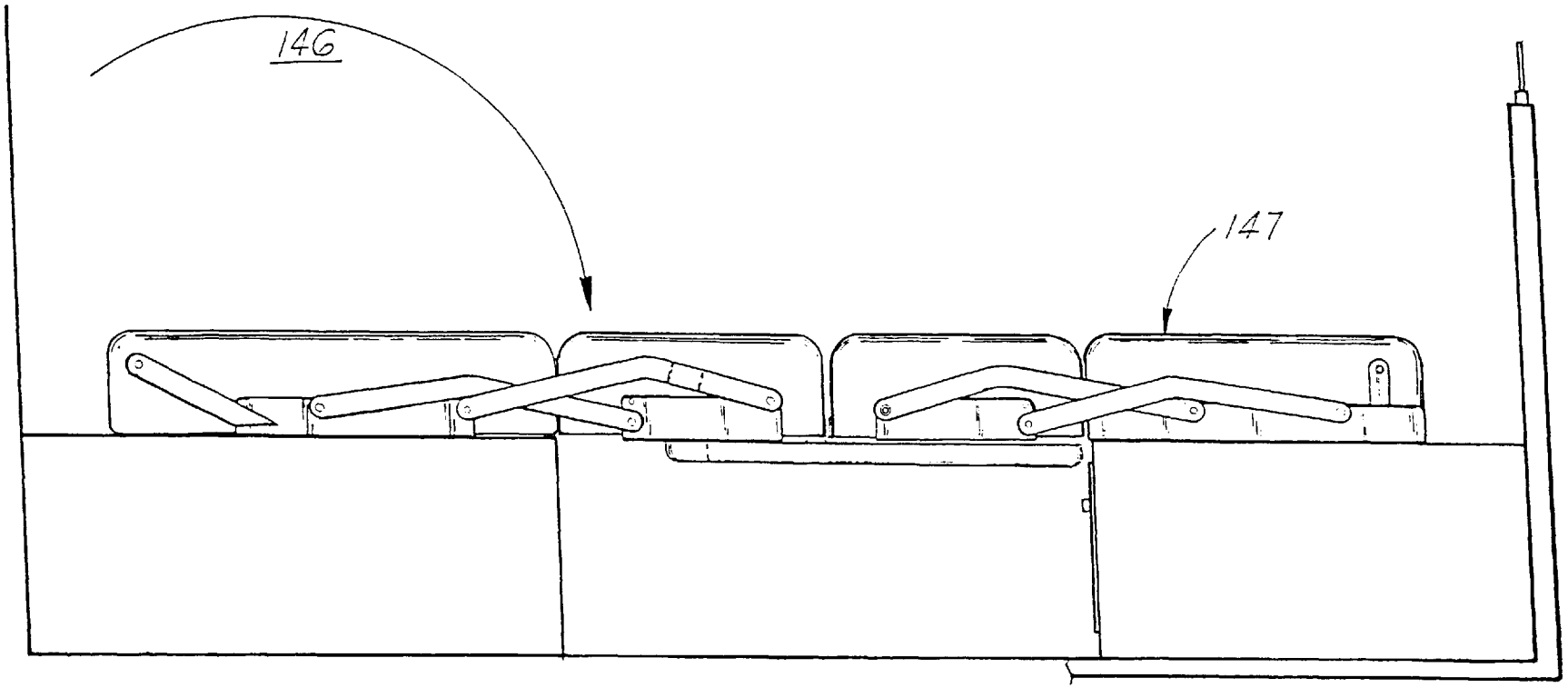
FIG. 13 is an end view of the invention of FIG. 12, illustrating the rear cushion of the second sofa positioned, via end brackets, in generally horizontally aligned fashion with the seat cushion of the second sofa, fully forming the bed of the present invention.

As shown in FIGS. 9 and 13, the back cushion of the second sofa may be pulled forward 146 and rotated in like manner to that of the first sofa, to allow the back to form a bed pad which fills the empty space between the seat of the second sofa and the horizontally situated back of the first sofa, forming a bed 147.

While it is shown that the present invention comprises the combination of the two sofas knocked down to form a single, relatively large bed (which may be full, queen size, or larger), it is noted that either of the sofa units may be utilized individually to form a single bed, as necessary or desirable.

Further, it is noted that a bunk may be provided along the end wall of the unit above the dining area, comprising a fold down unit mounted to the wall and supported via cable, chain, or the like, providing sleeping room for several users.

Continuing with FIGS. 16–19, the table T of the preferred embodiment of the present invention provides a stable, relatively large work/dining area supported in a comfortable and unobtrusive manner, providing ample leg 179 room above the seats.

As shown, the table T includes a main, table planar support member 169 having a top 170 and an underside 171, a first end 172 adjacent to wall 174, a second end 173 distal to wall 174, a floor 176 engaging leg 176 supporting the second end 173 of the table, and first 177 and second 178 upper support members suspended from ceiling 192, and supporting the first end 172 of table T.

Figure 16:
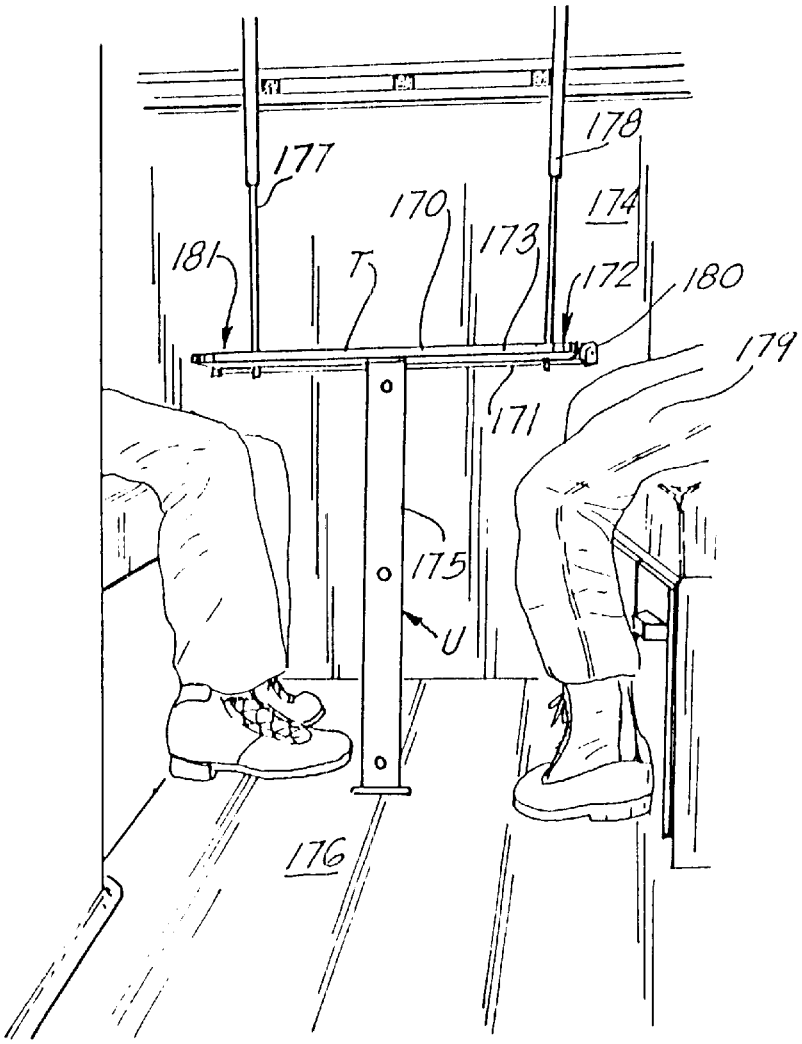
FIG. 16 is an end view of the dining/sleeping area of the invention of FIG. 9, illustrating the placement and configuration of the preferred table and first and second sofas, with first and second users situated thereupon, respectively.
Figure 19:
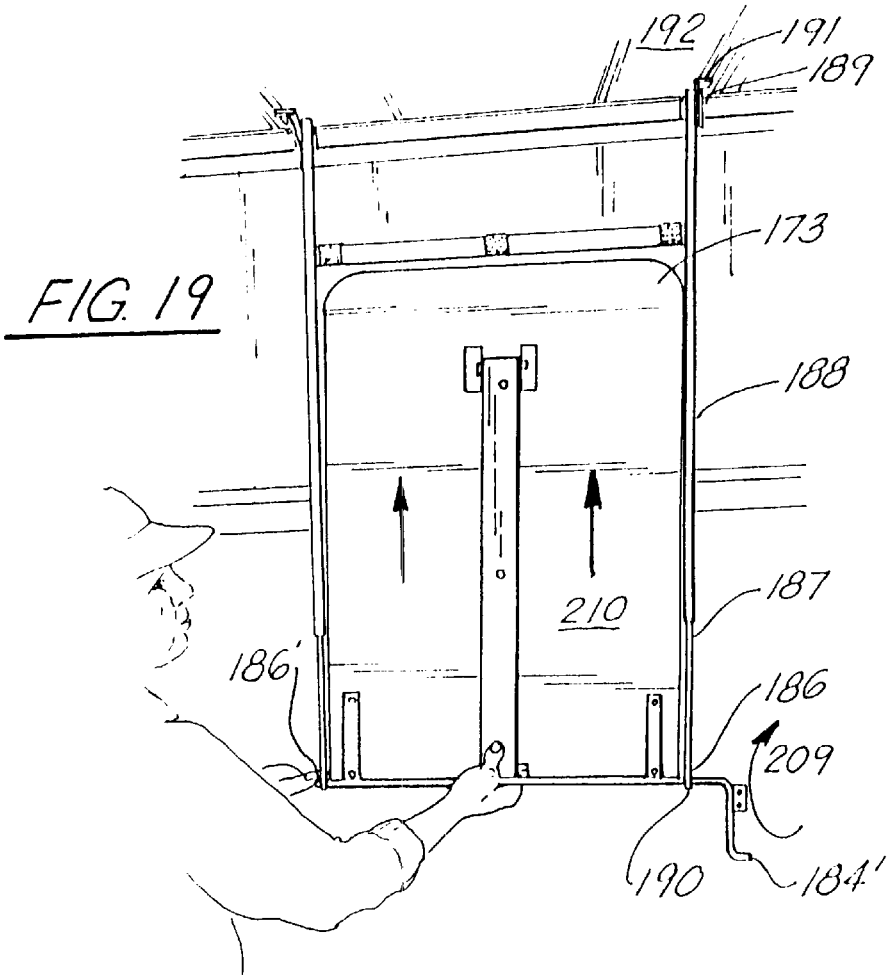
FIG. 19 is a side view of the table of FIG. 18, illustrating the table in a vertical position, with the user telescopically extending the rear support bracket downward, to position the table from storage position to use position.
Figure 21:
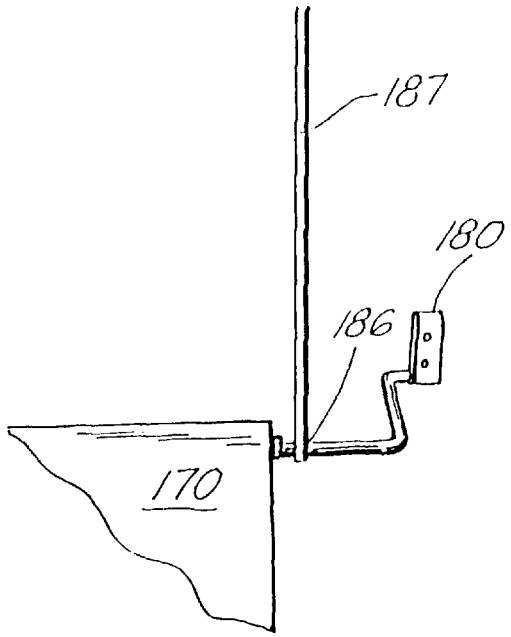
FIG. 21 is an isometric view of the rear engagement bracket of the table of the invention.

Aligned with the edge forming the first end 172 of table T is retaining rod 182 having first and second ends emanating from each side of the table, the retaining rod fixedly engaged to the underside of the table via holding members 183, 183', respectively, each end further providing a spacing length emanating from the table, the spacing lengths 185, 185' situated in generally aligned fashion with the longitudinal axis 211 of the table, each end terminating in an engagement bend 184, 184' in general parallel alignment with the length of rod situated between the spacing length 185, 185', (continuing with FIGS. 16, 19, and 21, so as to allow for the engagement of engagement bends 184, 184' with retaining clips 180, 181 affixed to the wall, respectively, anchoring the first end of the table to the wall when the table is deployed in the use position U.

Figure 17:
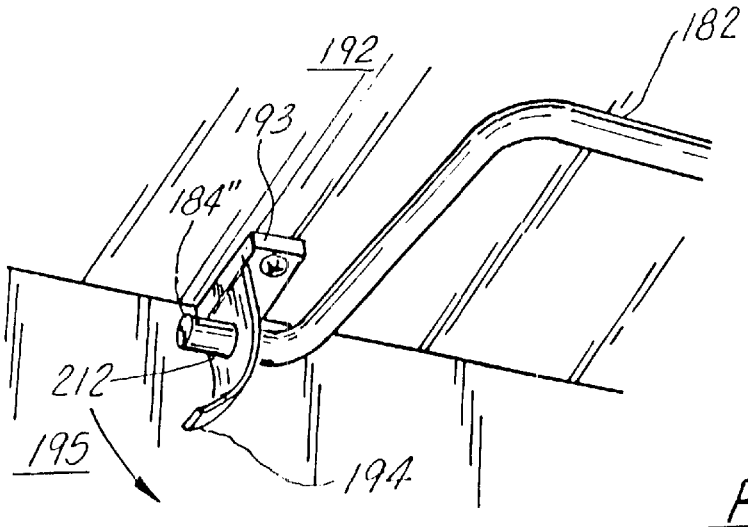
FIG. 17 is an isometric view of an exemplary support bracket for the table of FIG. 9, for retaining the table to the ceiling of the modular living quarters of the present invention.

Continuing with FIGS. 16–19, pivotally attached 186, 186' to said retaining rod, at opposing ends emanating from the underside of the table, are the first 177 and second 178 upper support members, respectively, each upper support member further comprising first 187 and second 188 telescoping pieces forming the upper support members, each support member further having first 189 and second 190 ends, the first end of each support member pivotally connected 191, 191' to the ceiling 192, respectively, as shown in FIG. 17, via bracket 193 affixed to the ceiling 192 of the unit, said bracket including a pivotally connected 195 engagement tab 194 having formed therein an aperture 212 configured to allow the passage of engagement rod end 184".

Figure 22:
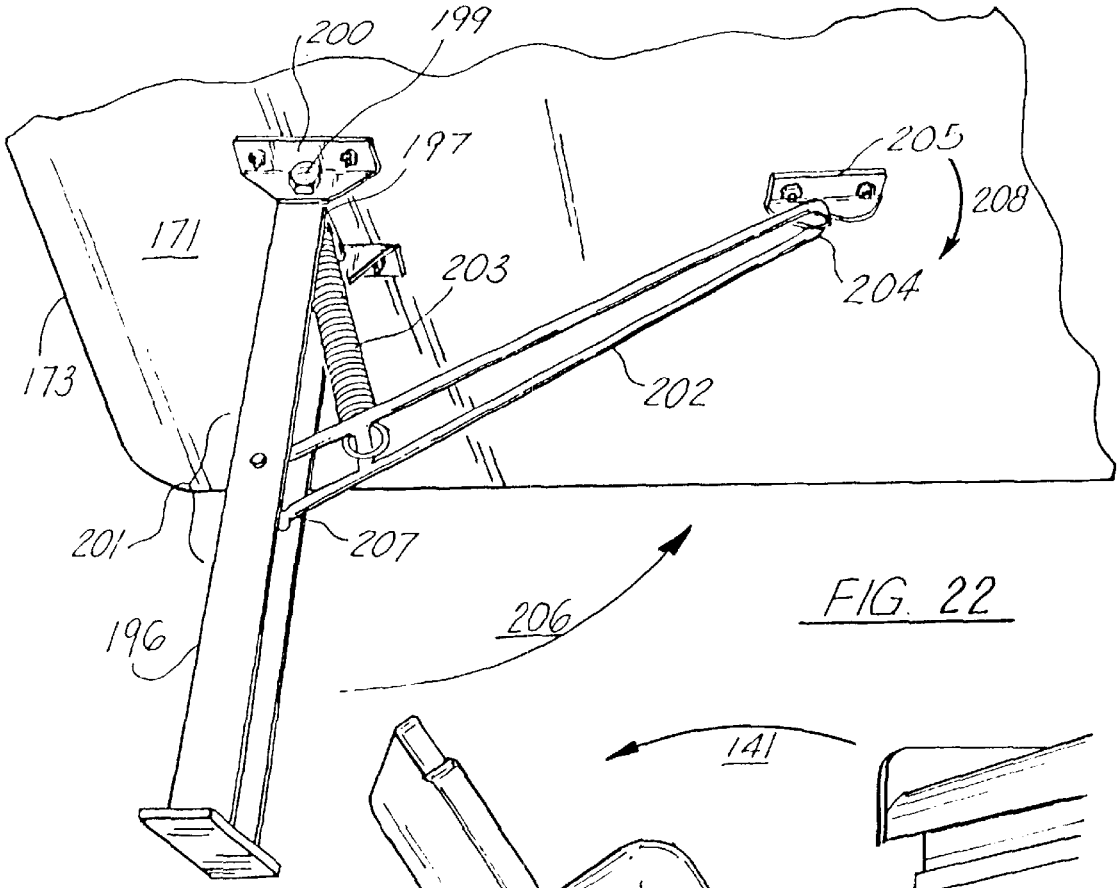
FIG. 22 is a bottom view of the table of FIG. 19, illustrating the support leg in its deployed position.
Figure 23:
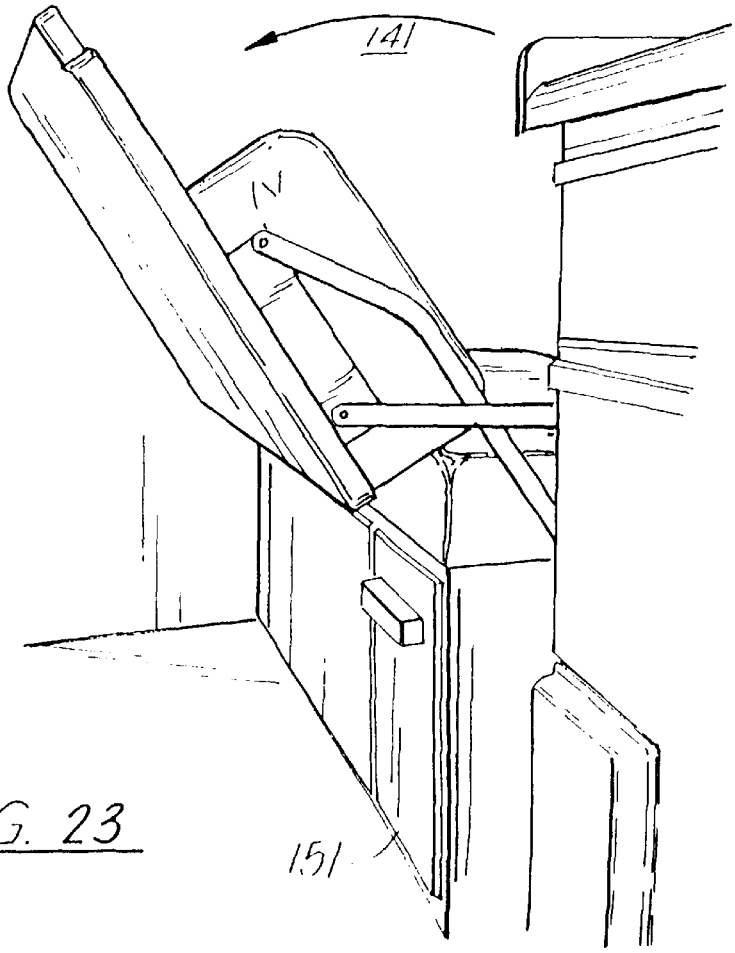
FIG. 23 is an isometric view of the first sofa of FIG. 10 illustrating the position of the sofa relative to the kitchen unit, and the positioning of the backrest from the counter position to the bed position.

Continuing with FIG. 22, the leg 196 supporting the second end 173 of table includes first 197 and second 198 legs, the first 197 end pivotally 199 connected to the underside 171 of table via bracket 200, the second end configured to engage the floor in use. Situated in the medial area 201 of leg is a brace 202 member, pivotally 207 connected to the leg at its first end, with the second end 204 of brace biased toward the underside 171 of the table via spring 203, the second end engaging engagement bracket 205 when the leg is deployed to anchor same in place.

The table is easily and securely stored in an unobtrusive position flush with the ceiling of the unit; the procedure for placing the storage is relatively straightforward, as will be shown.

First, the brace 202 is removed 208 from the engagement bracket 205, and the leg 196 is urged 206 toward and over the engagement bracket 205, enveloping same and aligning the leg with the underside of the table.

Next, continuing with FIG. 19, the second end 173 of the table is lifted until the table is in a generally vertical position; this lifting of the table disengages the engagement ends 184 from the end securing stops 180, 181, freeing the first end of the table from engagement with the wall. Next, the upward pressure 210 is applied to the table to lift same, retracting the telescopic upper support members 177, 178, until the second end 173 of the table almost engages the ceiling 192.

Figure 18:
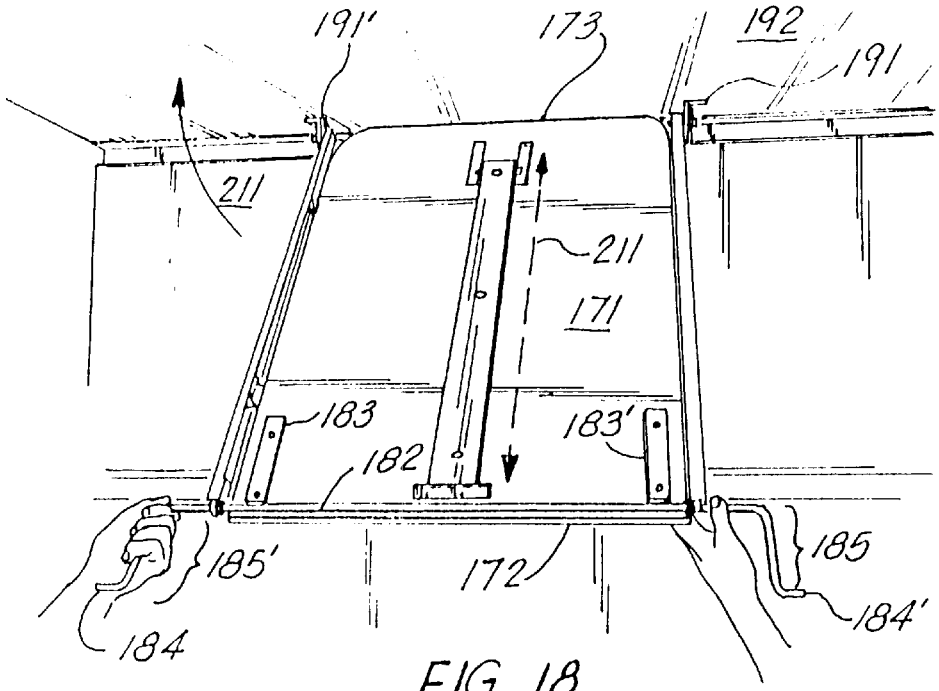
FIG. 18 is an isometric view of the table of the present invention, illustrating the disengagement of the support bracket, and pivoting of same, to position the table from storage position to use position.

Referring to FIG. 18, the first end 172 of the table is then lifted 211 towards the ceiling, pivoting the first end via pivotal connections 191, 191', until the first end is adjacent to the ceiling.

Lastly, referring to FIG. 17, each end of retaining rod 182, which forms an engagement end 184" is set to engage with engagement tab 194, by passing the aperture 212 formed in engagement tab through the rod end, securing same to the ceiling.

The table is thereby placed in storage flush with the ceiling, in an almost unnoticeable position; the preferred embodiment of the present invention further contemplates a table top which matches the ceiling design, so as to further camouflage the table in the storage position.

Deploying the table in the use position is simple, and merely accomplishing the above steps in reverse.

Like the modular bathroom system, the modular living system of the present invention may comprise electrical hookups, battery backup, a small generator, solar power, wind generator, or any number of power supply means already known and practiced in the art. The preferred embodiment of the present invention, configured to be mounted to a tractor/trailer unit, could receive power from the tractor's alternator as primary, and utilize a small generator when the tractor is off. Also, air conditioning/heating may be provided by the tractor, or a conventional roof mounted unit could be implemented.

Further, water and septic and grey water hookups, supplies and/or storage may be implemented, as is known. Also, LP or the like may be provided for heating, kitchen stove and/or oven, and even powering a refrigeration unit, as desired. Under the floor of the modular living unit, a storage area could be provided, which could include a separate LP service compartment, which would be sealed from the inside of the compartment and adjacent storage facility, the LP service compartment ideally having a separate exterior access.

With the advent or cellular telephones, laptop computers, and other miniature electronics and devices, the modular living unit of the present invention, properly equipped, could provide most of the comforts and conveniences of home, allowing the user(s) to work more efficiently, comfortably, and satisfactorily.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

Figure 24:
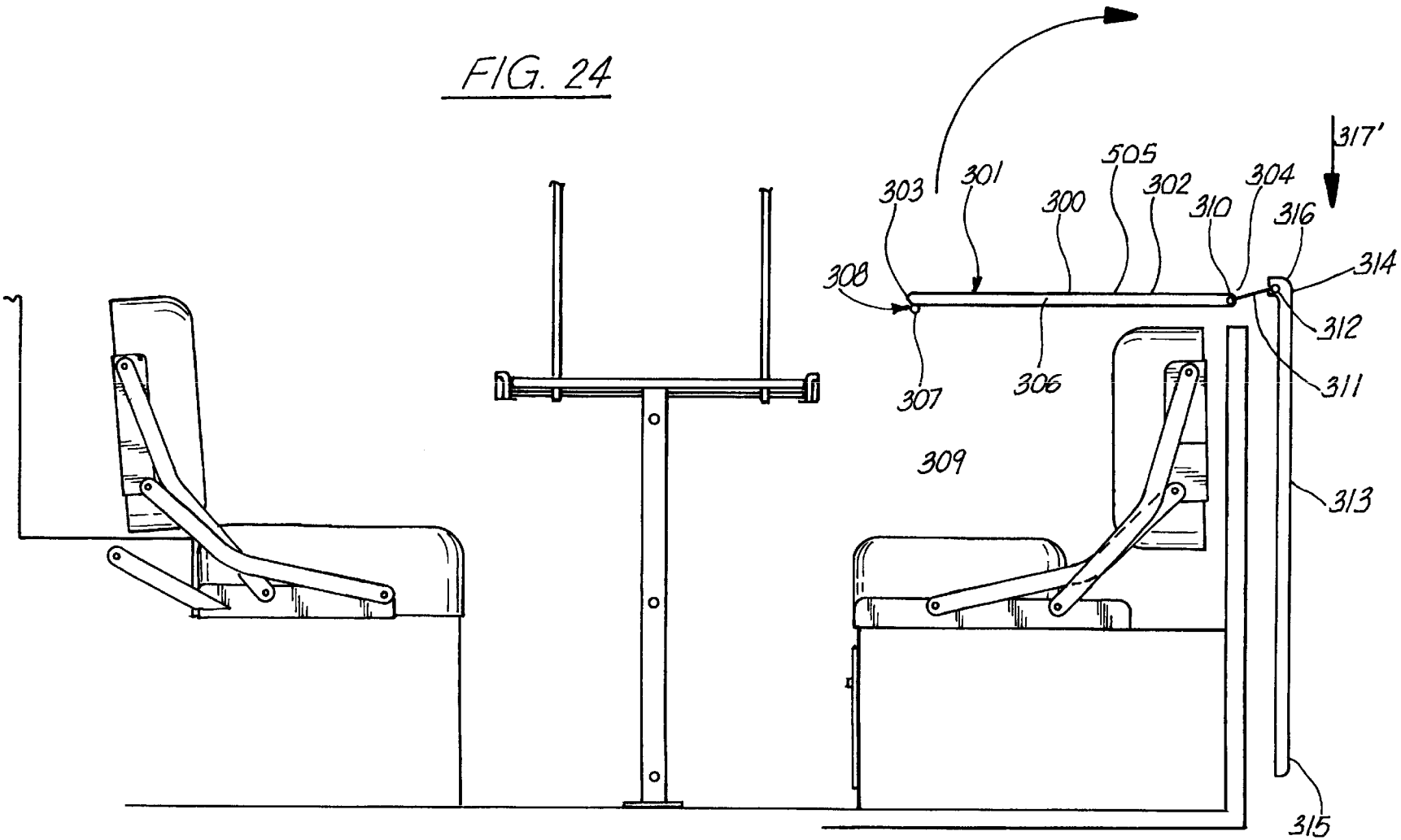
FIG. 24 is an end view of an alternative embodiment of the table of the dining/sleeping area of the invention, illustrating an alternative counter support arrangment in the storage position.
Figure 25:
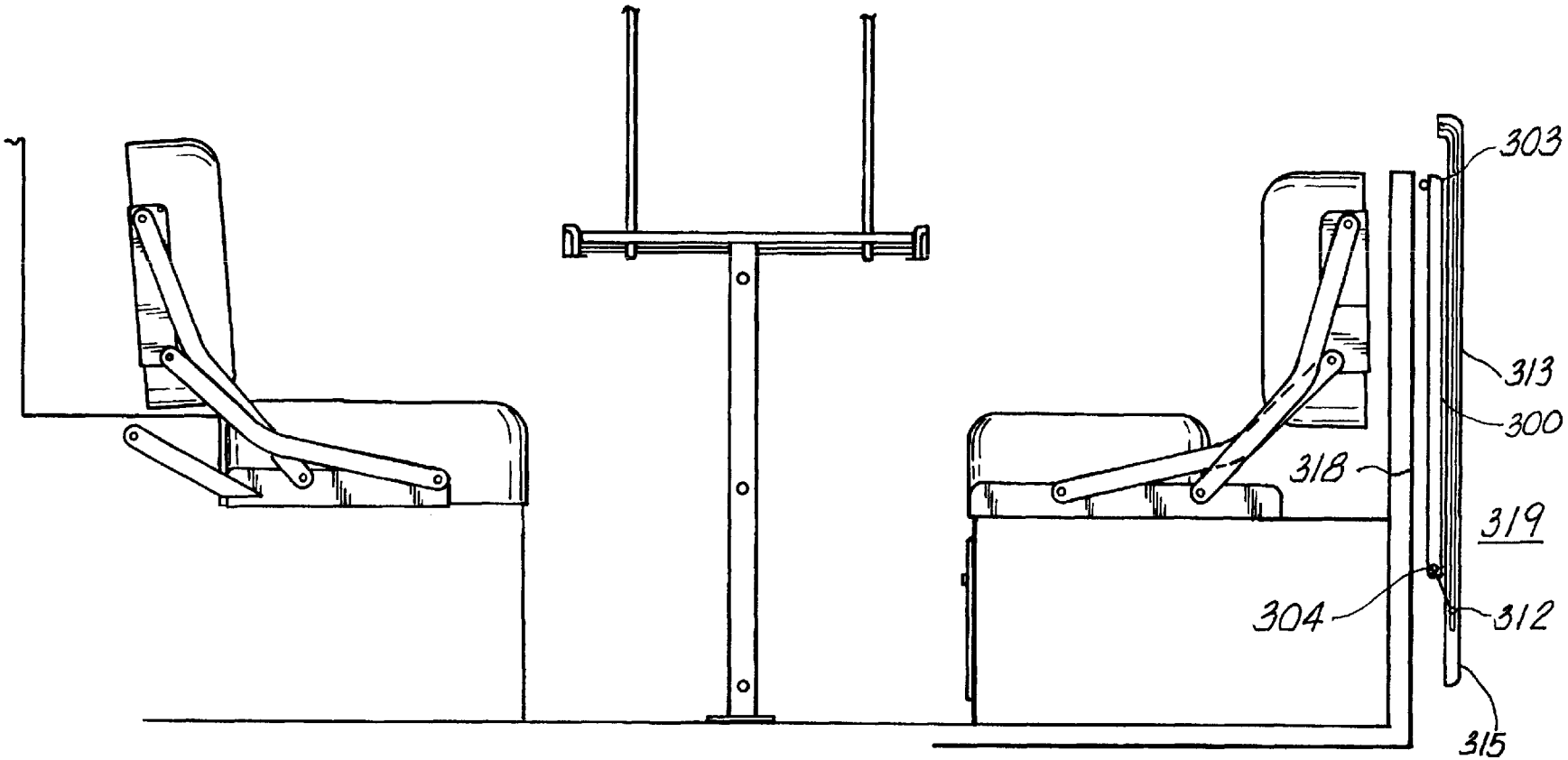
FIG. 25 is a top view of the alternative embodiment of FIG. 24, wherein the counter is in the deployed position.

Continuing with FIGS. 24 and 25, an alternative to the counter arrangment illustrated in FIG. 9 is shown, wherein the counter 300 has first 301 and second 302 ends, a front edge 303, a rear edge 304, a top 305, and a bottom 306. As shown, the counter has mounted under the front edge 303 a support pin 307 which slidingly engages an aperture 308 formed in the wall 309 to support the front edge of the counter, at the first 301 end. Likewise, there may be provided a similar, second, support pin/aperture arrangment at the second 302 end of the counter, if there is a wall or other support for the support pin to engage.

Continuing with the figures, the rear edge 304 of the counter 300 is supported at its first and second ends 301, 302, via a separate pivotal support 310 affixed to each respective ends of the counter, each support 310 having a spacer 311 communicating with a roller 312, which roller is slidingly engaged to its own vertical support track 313 having upper 314 and lower 315 ends, the upper end 314 having a right angled support extension 316 to support roller, and thereby counter, when the counter is in the horizontal support position, as shown in FIG. 24.

Continuing with FIGS. 24 and 25, when the counter of the present alternative embodiment is not in use, the user may disengage the support pin 307 from the aperture 308, and pivot 317 the counter into a generally vertical position, and lower 317' the counter (with the rear edge 304 down and the front edge 303 up), such that the counter 303 is stowed in vertical fashion between the seat back 318 and rear wall 319. When the counter 300 is lowered 317' as aforesaid, the roller 312 slides from the supporting position at the right angled support extension 316, and slides down support track, to the lower end of same.

To deploy the counter, the user merely lifts same from behind the seat back 318, pivots the unit such that the front edge 303 is in the frontal position with the counter in a generally horizontal configuration, engages the support pin 307 with its respective aperture 308, engage the other support pin at the other end of the counter, where available, while making sure that the roller 312 is engaged in the right angled support extension 316.

What is claimed is:

1. The method of providing a collapsible counter unit for supporting a counter over an object, comprising the steps of:

a. providing a counter unit comprising a counter having first and second ends, a top, a bottom, and front and rear edges, the first end of the counter adjacent to a wall, the counter unit further comprising:

a first support piece engaging said wall in the vicinity of said first end of said counter to support said first end of said counter above said object in a generally horizontal position;

a second support piece engaging said counter in the vicinity of the rear edge of said counter;

a vertical track mounted adjacent to the backside of said object, said track having a lower end and an upper end, said upper end further including a support extension (316) horizontally emanating from said vertical track at a right angle, said track configured to slidingly engage said second support piece such that said second support piece, when situated in said support extension, in concert with said first support piece, supports said rear edge of said counter in a generally horizontal position, said track further configured to allow said second support piece to selectively slide from said support extension, along said track, to said lower end of said track, so as to support said counter in a generally vertical storage position adjacent to the back side of said object;

b. supporting said rear edge of said counter in generally horizontal fashion by positioning said second support piece into said support extension;

c. supporting said front edge of said counter by engaging said counter to said wall with said first support piece;

d. placing said counter into a load supporting, horizontal planar support position;

e. disengaging said counter from said wall via said first support piece;

f. disengaging said rear edge of said counter and storing said counter, comprising the sub-steps of:

I. lifting said front edge of said counter, and pivoting said counter such that said counter is situated in a generally vertical position;

ii. sliding said second support piece horizontally out of said support extension, then down said vertical track, sliding said counter adjacent to the back side of the object, so as to stow said counter behind said object.

* * * * *